US008049708B2

(12) United States Patent
Santo et al.

(10) Patent No.: US 8,049,708 B2
(45) Date of Patent: Nov. 1, 2011

(54) HYBRID ANALOG AND DIGITAL ARCHITECTURE FOR CONTROLLING BACKLIGHT LIGHT EMITTING DIODES OF AN ELECTRONIC DISPLAY

(75) Inventors: Hendrik Santo, San Jose, CA (US); Dilip Sangam, Saratoga, CA (US); Gurjit Thandi, San Jose, CA (US); Kien Vi, Palo Alto, CA (US)

(73) Assignee: Atmel Corporation, San Jose, CA (US)

( * ) Notice: Subject to any disclaimer, the term of this patent is extended or adjusted under 35 U.S.C. 154(b) by 1059 days.

(21) Appl. No.: 11/652,739

(22) Filed: Jan. 12, 2007

(65) Prior Publication Data

US 2008/0170085 A1 Jul. 17, 2008

(51) Int. Cl.
*G09G 3/36* (2006.01)

(52) U.S. Cl. ..... 345/102; 345/76; 345/82; 345/690; 345/691; 345/692; 345/693; 315/291

(58) Field of Classification Search ..... 345/102, 345/76, 82, 690–693; 315/291
See application file for complete search history.

(56) References Cited

U.S. PATENT DOCUMENTS 5,912,568 A 6/1999 Kiley
6,107,985 A 8/2000 Walukas et al.
2006/0144213 A1 7/2006 Mann
2006/0221047 A1* 10/2006 Tanizoe et al. ..... 345/102
2006/0231627 A1 10/2006 Silverbrook et al.
2006/0256050 A1 11/2006 Ikeda
2007/0024213 A1* 2/2007 Shteynberg et al. ..... 315/291

FOREIGN PATENT DOCUMENTS

GB 2369730 A 6/2002
KR 2006-0116736 11/2006

OTHER PUBLICATIONS

Friend et al., "Polymer diodes", Physics World, vol. 12, No. 6, pp. 35-40, Published Jun. 1999.
International Search Report for PCT/US08/50917, mailed Jul. 15, 2008.
European Search Report dated Sep. 3, 2010 for EP Application No. 08727615.0-1228/2102733, 7 pages.

* cited by examiner

*Primary Examiner* — Richard Hjerpe
*Assistant Examiner* — Saifeldin Elnafia
(74) *Attorney, Agent, or Firm* — Fish & Richardson P.C.

(57) ABSTRACT

The present invention provides a controller for controlling strings of LEDs in a liquid crystal display. The hybrid controller uses both analog and digital circuit components. Error amplifiers are used to compare analog feedback signals received from the LED strings with reference signals. The results of those comparisons are converted to digital data and processed by a digital signal processor (DSP). The DSP calculates the drive voltages for the LED strings based on the deviation between the actual current flows (represented by feedback signals) and the desired current flows (represented by reference signals) through the LED strings. Analog drivers provide the drive voltages to the LED strings.

18 Claims, 5 Drawing Sheets

Prior Art Analog Control Architecture

Prior Art Analog Control Architecture

HYBRID ANALOG AND DIGITAL ARCHITECTURE FOR CONTROLLING BACKLIGHT LIGHT EMITTING DIODES OF AN ELECTRONIC DISPLAY

FIELD OF INVENTION

The present invention relates to electronic display technology, and particularly to a hybrid architecture of analog and digital circuitry for controlling the light emitting diode (LED) strings of the backlights of electronic displays.

BACKGROUND OF THE INVENTION

Backlights are used to illuminate liquid crystal displays (LCDs). LCDs with backlights are used in small displays for cell phones and personal digital assistants (PDA), as well as in large displays for computer monitors and televisions. Typically, the light source for the backlight includes one or more cold cathode fluorescent lamps (CCFLs). The light source for the backlight can also be an incandescent light bulb, an electroluminescent panel (ELP), or one or more hot cathode fluorescent lamps (HCFLs).

The display industry is enthusiastically perusing the use of LEDs as the light source in the backlight technology because CCFLs have many shortcomings: they do not easily ignite in cold temperatures, require adequate idle time to ignite, and require delicate handling. LEDs generally have a higher ratio of light generated to power consumed than the other backlight sources. So, displays with LED backlights consume less power than other displays. LED backlighting has traditionally been used in small, inexpensive LCD panels. However, LED backlighting is becoming more common in large displays such as those used for computers and televisions. In large displays, multiple LEDs are required to provide adequate backlight for the LCD display.

Circuits for driving multiple LEDs in large displays are typically arranged with LEDs distributed in multiple strings. FIG. 1 shows an exemplary flat panel display 10 with a backlighting system having three independent strings of LEDs 1, 2 and 3. The first string of LEDs 1 includes 7 LEDs 4, 5, 6, 7, 8, 9 and 11 discretely scattered across the display 10 and connected in series. The first string 1 is controlled by the driver circuit 12. The second string 2 is controlled by the driver circuit 13 and the third string 3 is controlled by the driver circuit 14. The LEDs of the LED strings 1, 2 and 3 can be connected in series by wires, traces or other connecting elements.

The strings 1, 2 and 3 are controlled by a controller by way of drivers 12, 13 and 14 respectively. FIG. 2 shows a prior art controller 20. FIG. 2 specifically shows the controller 20 for controlling string 1, by way of example. However, the controller 20 can also be used to control strings 2 and 3. The controller 20 includes an error amplifier 22, a continuous time loop compensation circuit 24, summation node, a local feedback loop 27 and a system feedback loop 28. The controller 20 provides a real time analog control of the string 1. The error amplifier 22 receives a reference voltage $V_{REF}$ as an input. The error amplifier 22 also receives a feedback signal $V_{FB}$ from the LED string 1 as an input by way of the system feedback loop 28. One of ordinary skill in the art will appreciate that the system feedback loop 28 includes the capability to scale the feedback signal such that the error amplifier 22 can properly compare the feedback signal with $V_{REF}$.

Typically, $V_{REF}$ is indicative of the desired drive voltage that should be provided to string 1 to cause a desired current to flow through string 1. The error amplifier 22 compares the $V_{REF}$ with the feedback voltage $V_{FB}$, which can be the sensed voltage indicative of the actual current flowing through string 1, and provides a result of the comparison to the loop compensation block 24. The output of the error amplifier 22 represents the correction that must be made to the drive voltage of string 1 to cause the desired current to flow through string 1. The error amplifier 22 continuously receives the feedback signal in real time from string 1 and provides the correction signal to the loop compensation block 24.

The loop compensation block 24 provides the proper drive voltage to string 1 by way of the driver 12, in response to receiving the correction signal from the error amplifier 22. The loop compensation block 24 thus continuously adjusts the drive voltage for string 1 in real time. FIG. 2 shows that the loop compensation block 24 is coupled to the driver 12 by way of the summation node (Σ). The summation node receives the output of the loop compensation block 24 as an input. The summation node also receives a feedback signal from string 1 by way of the local feedback loop 27. The feedback signal received by way of the local feedback loop 27 can be representative of, for example, the noise in string 1. The feedback signal received by way of the local feedback loop 27 can also be representative of, for example, an open circuit condition or a short circuit condition caused by string 1 or some other part of the display circuit. The summation node can provide for a quick adjustment to the driver 12, including shutting down the driver 12 output during abnormal conditions, depending on the circuit design and goals.

FIG. 3 shows another prior art controller 30 for controlling string 1. The controller 30 includes an analog to digital (A/D) converter 31, an analog to digital (A/D) converter 33, a digital signal processor (DSP) 32, a digital to analog (D/A) converter 34, and a buffer 35. The controller 30 provides for digital control of string 1 by way of the driver 12. The A/D converter 33 receives a reference signal $V_{REF}$ as an input. Typically, $V_{REF}$ is indicative of the desired voltage that should be used to drive string 1 in order to cause a desired current to flow through string 1. The A/D converter 33 converts the analog $V_{REF}$ signal into digital data and provides the digital data to the digital signal processor (DSP) 32.

The A/D converter 31 receives a feedback signal $V_{FB}$ by way of the system feedback loop 38. $V_{FB}$ can be the sensed voltage representative of the current flowing through string 1. The A/D converter 31 converts the analog $V_{FB}$ signal into digital data and provides the digital data to the DSP 32. The DSP 32 can be programmed to use the digital data received from the A/D converter 31 to determine the drive voltage for string 1. The DSP 32 can make intelligent decisions about controlling string one because it has access to various programs, comparison algorithms, look up tables and the like, that provide for consideration of various real-time system variables (e.g. ambient temperature) and non-real time system variables in the decision making. The DSP 32 provides the digital data related to the selected drive voltage to the digital to analog (D/A) converter 34. The D/A converter 34 converts the digital data into an analog drive signal, and provides the analog drive signal to the driver 12.

FIG. 3 shows that the DSP 32 is coupled to the driver 12 by way of the buffer 35. The buffer 35 can be used to store and hold the analog signals received from the D/A converter 34. The buffer 35 can include, for example, banks of storage capacitors for storing analog signals. The buffer 35 can be used to convert the outputs of the D/A converter 34 into smooth signals, for example, square waves, for driving string 1. FIG. 3 also shows that DSP 32 receives a feedback signal from string 1 by way of the local feedback loop 37. An analog to digital (A/D) converter 36 converts the analog feedback signal into digital data. The feedback signal received by way of the local feedback loop 37 can be representative of, for example, the noise in string 1. The feedback signal received by way of the local feedback loop 37 can also be representative of, for example, an open circuit condition or a short circuit condition caused by string 1 or some other part of the display circuit. The DSP 32 can provide for a quick adjustment to the driver 12, including shutting down the driver 12 output during abnormal conditions, depending on the algorithms and programs included in the DSP 32.

The controllers 20 and 30 shown in FIGS. 2 and 3 have many drawbacks. Controller 20 operates singularly according to the natural properties and characteristics of the analog circuit components, such as resistors, capacitors and inductors, and cannot be programmed to perform intelligent operations. Controller 20 is also subject to noise and delays that are inherent in analog circuit components. Controller 30 is subject to a relatively slow start up and boot up periods, inherent in digital systems. Also, the analog to digital to analog conversions and the digital signal processing result in time delays, and, as a result, real time control may not be available for many applications of controller 30. Furthermore, to program, debug or repair the DSP 32 during operation of the controller 30, the DSP 32 freezes the digital data provided to the D/A converter 34. That results in D/A converter 34 continuously providing the same output signal to the driver 12 during the freeze period. The feedback signal received by way of the system feedback loop 38 is ignored during the freeze period. That is undesirable.

The present invention provides a low power, high speed controller with a quick start-up period that can be programmed for intelligent decision making and can also perform real time operations.

SUMMARY OF THE INVENTION

The present invention provides a controller for controlling strings of LEDs in electronic displays including liquid crystal display. The hybrid controller uses both analog and digital circuit components. Error amplifiers are used to compare analog feedback signals received from the LED strings with reference signals. The results of those comparisons are converted to digital data and processed by a digital signal processor (DSP). The DSP calculates the drive voltages for the LED strings based on the deviation between the actual current flows (represented by feedback signals) and the desired current flows (represented by reference signals) through the LED strings. Analog drivers provide the drive voltages to the LED strings. The DSP outputs can be latched, so that during the initialization of the DSP or when DSP is non-operational for various reasons, the analog drivers can provide drive voltages to the LED strings. A multiplexor is used for the sequential processing of the LED strings by the DSP.

BRIEF DESCRIPTION OF THE DRAWINGS

The above and other objects and advantages of the present invention will be apparent upon consideration of the following detailed description, taken in conjunction with the accompanying drawings, in which like reference characters refer to like parts throughout, and in which.

DETAILED DESCRIPTION OF THE INVENTION

Figure 1:
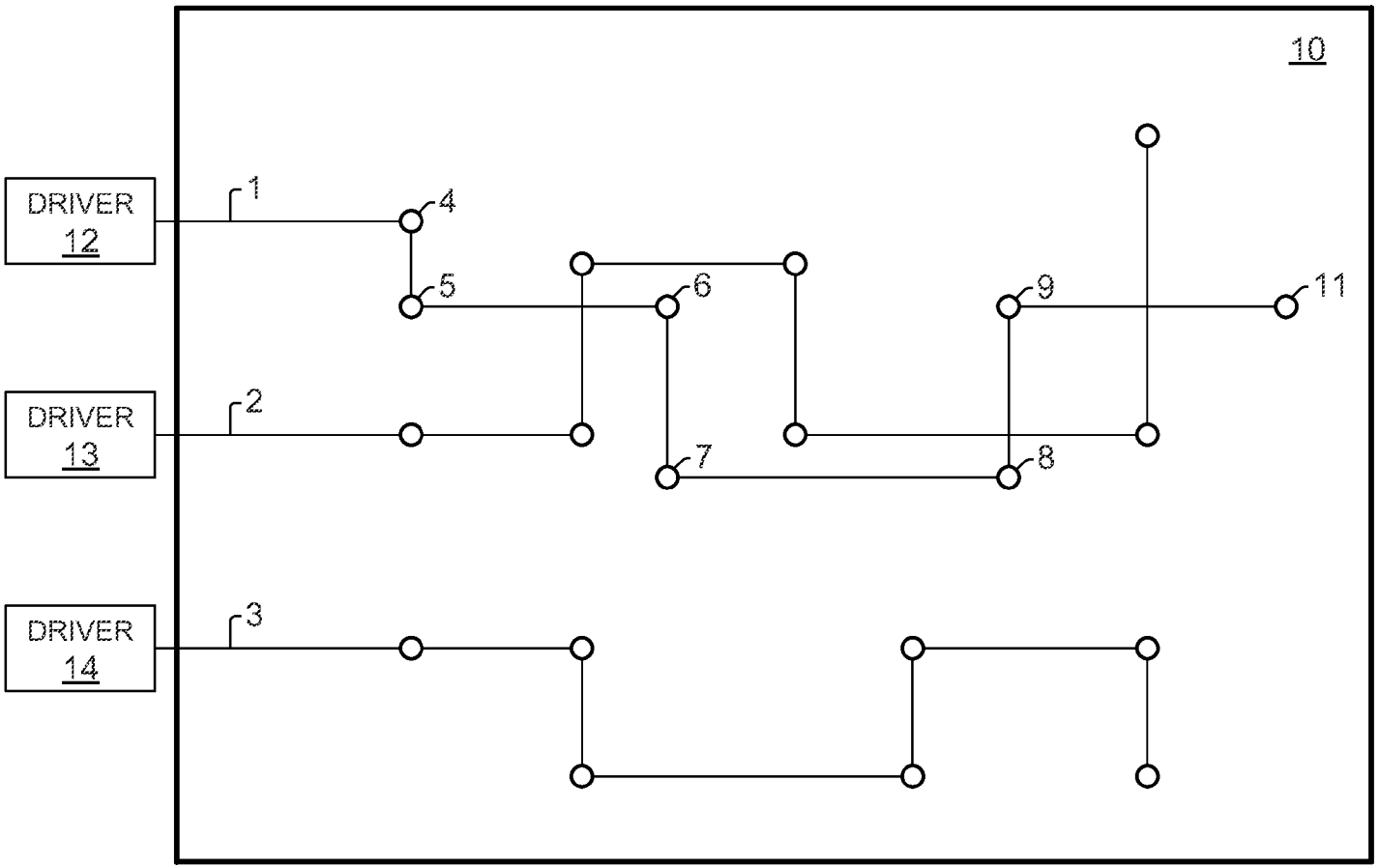
FIG. 1 Prior Art
FIG. 1 illustrates an exemplary display implementing LED strings.
Figure 2:
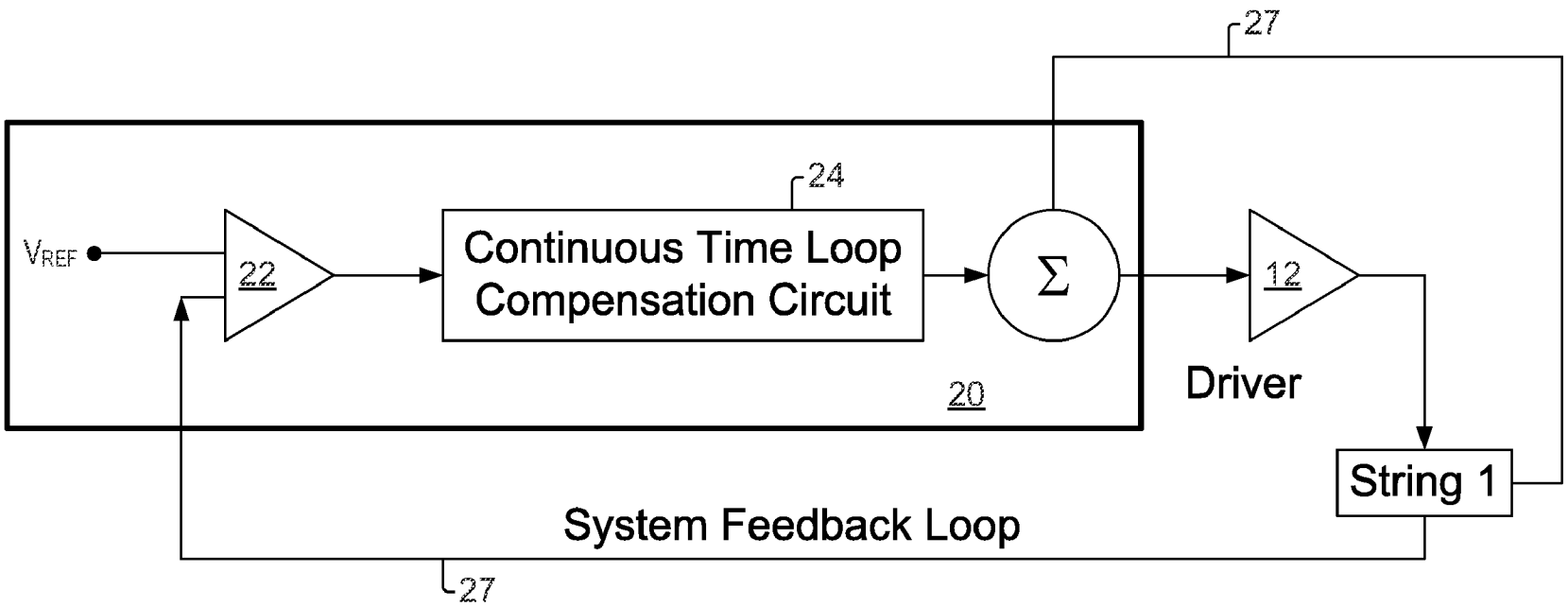
FIG. 2 illustrates the prior art analog control architecture for controlling a LED string.
Figure 3:
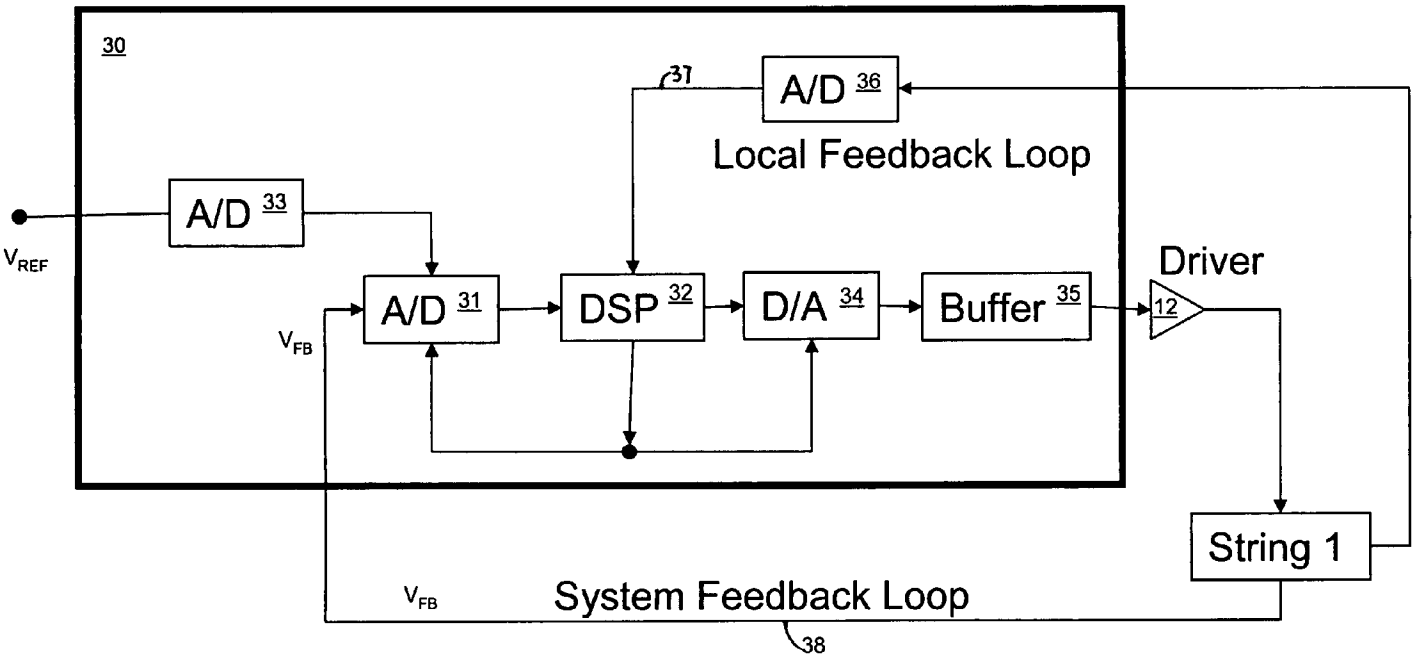
FIG. 3 illustrates the prior art digital control architecture for controlling a LED string.
Figure 4:
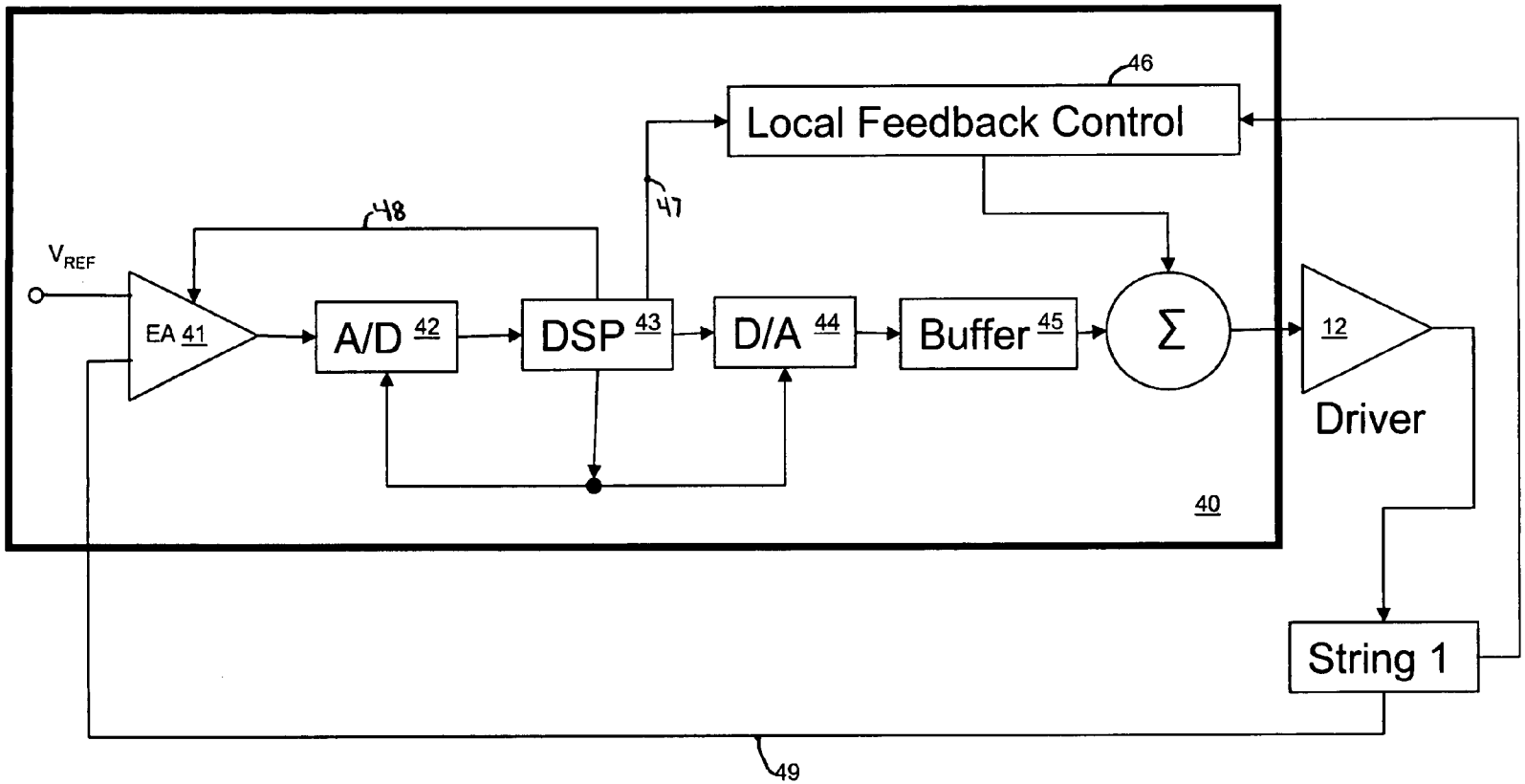
FIG. 4 illustrates an exemplary architecture of the present invention.

FIG. 4 illustrates an exemplary controller 40 of the present invention for controlling string 1 shown in FIG. 1. The controller 40 includes a combination of analog and digital circuit components. In FIG. 4, an error amplifier 41 is shown coupled to an analog to digital (A/D) converter 42. The A/D converter 42 is coupled to a digital signal processor (DSP) 43. The DSP 43 is coupled to a digital to analog (D/A) converter 44. The D/A converter 44 is coupled to the driver 12 by way of buffer 45 and a summation node (Σ). The driver 12 is coupled to string 1. In one embodiment, the controller 40 is implemented in an integrated circuit (IC) chip.

The error amplifier 41 is an analog circuit component. The error amplifier 41 receives a reference signal $V_{REF}$ as an input. The reference signal $V_{REF}$ can be indicative of the desired drive voltage for string 1. The error amplifier also receives a feedback signal $V_{FB}$ by way of the system feedback loop 49 as another input. The feedback signal $V_{FB}$ received by way of the system feedback loop 49 can be indicative of the current flowing through string 1. The error amplifier 41 compares the $V_{REF}$ signal with the $V_{FB}$ signal, and provides a result of the comparison to the A/D converter 42. The system feedback loop 49 can include circuitry to scale the values of the feedback signal $V_{FB}$ such that the error amplifier 41 can properly compare the $V_{REF}$ and the $V_{FB}$ signals on the same scale. One of ordinary skill in the art will appreciate that various comparator circuits known in the art can be substituted in place of the error amplifier 41, for comparing the $V_{REF}$ signal with the $V_{FB}$ signal.

In one embodiment, the output of the error amplifier 41 represents the correction that must be made to the drive voltage for string 1 to cause string 1 to output the desired current. The desired current flow for string 1 depends on the images being displayed on display 10 shown in FIG. 1, and can be determined by DSP 43 or another component of display 10 (not shown). In one embodiment, the level of the output of the error amplifier 41 indicates the amount of deviation between the actual current flowing through string 1 and the desired current flow for string 1. In one embodiment, a higher error amplifier 41 output represents a larger difference between the actual and desired currents of string 1 than a lower error amplifier 41 output. In one embodiment, the output of the error amplifier 41 progressively increases as the differences between the actual and desired current flows of string 1 increase.

The A/D converter 42 receives the output of the error amplifier 41 and converts it into digital data. The A/D converter 42 transmits the digital data to the DSP 43. In one embodiment, the DSP 43 includes a state machine. In one embodiment, the DSP 43 includes a programmable microprocessor. In one embodiment, the DSP 43 includes a sequencer for processing digital data by sequencing it through various processing units. The DSP 43 can process the digital data received from the A/D converter 42 using various algorithms, look up tables, subroutines, and the like, to determine the required drive voltage for string 1. The DSP 43 provides the digital to analog (D/A) converter 44 with digital data representative of the determined drive voltage. The D/A converter 44 converts the digital data into an analog signal and transmits the analog signal to the buffer 45. The A/D converter 42 and the D/A 44 can be components of the DSP 43.

The buffer 45 can be a bank of capacitors, for example. The buffer 45 converts the analog signal received from the D/A converter 44 into a smooth signal, for example a square wave, and transmits it to the driver 12 by way of the summation node.

As shown in FIG. 4, the DSP 43 can communicate with the error amplifier 41 by way of the connection 48. The connection 48 can be wired or wireless connection. The DSP 43 can shut off the error amplifier 41. The DSP 43 can also adjust the value of the reference voltage $V_{REF}$. The DSP 43 can communicate with the local feedback control circuit 46 by way of the connection 47. The connection 47 can be wired or wireless connection. The local feedback control loop circuit 46 receives a feedback signal from string 1 and provides it to the summation node. The summation node adjusts the signal level of the output of the D/A converter 44 based on the feedback signal received from the local feedback control circuit 46, and provides the adjusted signal to the driver 12. The feedback signal received from the local feedback loop can include noise, for example.

Also, the local feedback control circuit 46 can shut off the summation node upon the occurrence of abnormal conditions, such as open circuit or short circuit conditions. The local feedback circuitry 46 can shut off the summation node circuit by triggering a protection circuitry (not shown) in case of an abnormal condition. In one embodiment, the local feedback control circuit 46 can cut off any drive voltage to string 1 by shutting off the summation node circuit. The DSP 43 can activate or deactivate the local feedback control circuit 46.

One of ordinary skill in the art will appreciate that during start-up, the analog component of the controller 40, namely the error amplifier 41, and the driver 12, require much smaller initialization periods than the digital components of the controller 40. In one embodiment, the DSP 43 is programmed to latch the memory locations or registers of the digital data values that are provided to the D/A converter 44 during shutdown. Latching prevents the data values present in memory registers and locations from destruction, such that they are frozen. In another embodiment, the DSP 43 is programmed to latch the memory locations or registers of the digital data values that are provided to the D/A converter 44 until they are changed by the DSP. In yet another embodiment, the memory locations or registers of the DSP 43 can be adjusted prior to the initiation of the start up sequence for the controller 40.

In the above embodiments, according to one aspect of the present invention, the driver 12 can start providing drive voltages to string 1 even while the DSP 43 is executing its initialization sequence. According to another aspect of the present invention, the driver 12 can continue to provide drive voltages to string 1 even when the DSP 43 is shut off, debugged or being programmed. In that aspect of the present invention, the D/A converter 44 converts the same latched digital data into analog signals while the DSP 43 is shut off, being debugged or being programmed. According to yet another aspect of the present invention, the driver 12 can be shut down based upon the occurrence of abnormal conditions such as open circuit or short circuit at string 1 even when the DSP is in the initialization mode, shut off, being debugged or being programmed. In that aspect of the present invention, the local feedback control circuit 46 monitors the feedback signals received from string 1 for any abnormalities in the operation of string 1, and shuts off the summation node circuit upon the occurrence of an abnormal event.

Figure 5:
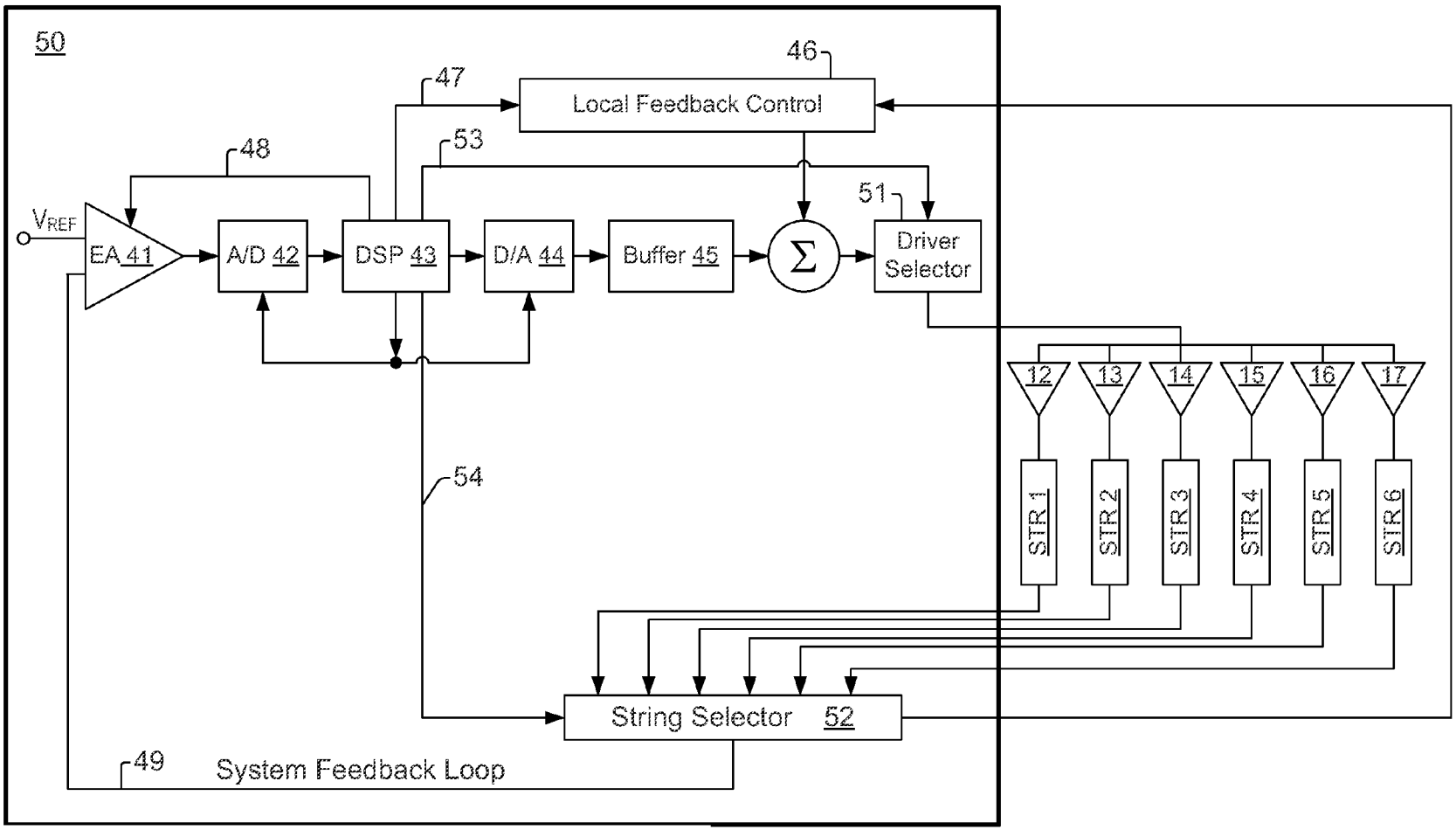
FIG. 5 illustrates another exemplary architecture of the present invention.

FIG. 5 illustrates an exemplary implementation of the architecture of the present invention for controlling multiple LED strings of a display. The controller 50 controls six strings STR1, STR2, STR3, STR4, STR5 and STR6 by way of drivers 12, 13, 14, 15, 16 and 17 respectively. The controller 50 includes many of the same components included in controller 40 including the error amplifier 41, the A/D converter 42, the DSP 43, the D/A converter 44, the buffer 45, the summation node circuit and the local feedback control circuit 46. The controller 50 also includes a driver selector circuit 51 for selecting a particular driver 12, 13, 14, 15, 16 or 17 and a string selector 52 for selecting $V_{FB}$ signal for a particular string STR1, STR2, STR3, STR4, STR5 and STR6.

In one embodiment, the DSP 43 selects a string STR1, STR2, STR3, STR4, STR5 or STR6 for processing. In one embodiment, the DSP 43 sequentially and periodically processes the strings STR1, STR2, STR3, STR4, STR5 and STR6. In another embodiment, the DSP 43 can randomly select a string STR1, STR2, STR3, STR4, STR5 or STR6 for processing. In yet another embodiment, the DSP 43 can be programmed to intelligently select a string STR1, STR2, STR3, STR4, STR5 or STR6 for processing, based on various factors and circuit conditions.

The DSP 43 can select the driver 12, 13, 14, 15, 16 and 17 by communicating with the driver selector 51 by way of the connection 53, and select the $V_{FB}$ signal of a particular string STR1, STR2, STR3, STR4, STR5 or STR6 by way of the connection 54. In one embodiment, the driver selector circuit 51 and the string selector circuit 52 include multiplexors. In one embodiment, the driver selector circuit 51 and the string selector circuit 52 can be implemented inside the DSP 43. The driver selector circuit 51 and the string selector circuit 52 can be implemented in hardware, software or firmware. In one embodiment, the $V_{REF}$ voltage levels for the various strings STR1-STR6 differ. In that embodiment, the DSP 43 provides the $V_{REF}$ voltage level to the error amplifier 41, by way of the connection 48, for the selected string STR1, STR2, STR3, STR4, STR5 or STR6.

The present invention combines digital and analog control methods. The digital and analog fields are significantly different and those of ordinary skill in the art are normally skilled only in digital or analog systems. One of ordinary skill in the art will appreciate that the techniques, structures and methods of the present invention above are exemplary. The present inventions can be implemented in various embodiments without deviating from the scope of the invention.

The invention claimed is:

1. A controller for an electronic display, the controller comprising:

an input circuit for receiving an analog input signal from the electronic display;

the input circuit for comparing the analog input signal with a reference signal;

an analog to digital converter circuit coupled to the input circuit for converting a resultant signal of the comparison into digital data;

a digital signal processor coupled to the analog to digital converter circuit for processing the digital data;

a digital to analog converter circuit coupled to the digital signal processor for converting the processed digital data into an analog signal;

a summation node coupled to the digital to analog converter circuit for combining the analog signal and a feedback signal from the electronic display; and a driver circuit coupled to the summation node for providing an adjusted level of the analog signal to the electronic display.

2. The controller of claim 1, further comprising:

a latching circuit coupled to said digital signal processor;

wherein the digital signal processor is configured to latch the processed digital data using the latching when the signal processor is: executing an initialization sequence, shut off, being debugged, or being programmed.

3. The controller of claim 2, wherein the controller activates the latching circuit during a shutdown period of the electronic display.

4. The controller of claim 2, wherein the latching circuit is configured to preserve the processed digital data from a previous shutdown period of the electronic display for use during an initialization period of the electronic display.

5. The controller of claim 1, further comprising a local feedback control circuit, wherein:

the local feedback control circuit is coupled to the electronic display to receive the feedback signal;

the summation node is coupled to the local feedback control circuit to receive the feedback signal; and the local feedback control circuit is configured to shut off the summation node upon the occurrence of abnormal conditions.

6. The controller of claim 1, further comprising:

a plurality of strings of light emitting diodes coupled to the driver circuit;

wherein the plurality of strings of light emitting diodes are coupled to the input circuit for providing analog input signals to the input circuit.

7. The controller of claim 1, wherein the input circuit includes an error amplifier.

8. The controller of claim 1, wherein:

the input circuit is configured to receive the reference signal as a first input and the analog input signal from a string of light emitting diodes as a second input; and the input circuit includes an error amplifier for comparing the first input with the second input and providing a result of the comparison to the analog to digital converter circuit.

9. The controller of claim 7, further comprising a buffer coupled to the digital to analog converter circuit to convert the analog signal into a square wave.

10. The controller of claim 7, wherein the digital signal processor is configured to communicate with the error amplifier to shut off the error amplifier, and the digital signal processor is configured to adjust the reference signal.

11. A liquid crystal display comprising:

a plurality of strings of light emitting diodes for providing backlighting for the liquid crystal display;

a string selector circuit for selecting a string of the plurality of strings;

a comparator circuit for comparing a reference analog signal with a first feedback signal indicative of the current flowing through the selected string; and a digital signal processor for determining a drive voltage for the selected string based upon a result of the comparison; wherein the reference analog signal is indicative of the desired current flow through the selected string; and an analog driver circuit coupled to the digital signal processor and a second feedback signal from the selected string for providing a drive voltage to the selected string, wherein the analog driver circuit is configured to provide a drive voltage to the selected string using the second feedback signal in a period in which the digital signal processor is not in an operating mode.

12. The liquid crystal display of claim 11, wherein the plurality of strings of light emitting diodes include six strings of light emitting diodes.

13. The liquid crystal display of claim 11, wherein the comparator circuit includes an error amplifier for comparing analog signals.

14. The liquid crystal display of claim 11, wherein the digital signal processor includes a programmable microprocessor.

15. The liquid crystal display of claim 11, wherein the string selector circuit includes a multiplexor.

16. A method for controlling a liquid crystal display, the method comprising:

receiving first analog feedback signal indicative of a current flowing through a string of light emitting diodes;

comparing the first analog feedback signal with an analog reference signal;

converting the resultant analog signal of the comparison into digital data;

processing the digital data to determine a drive voltage level for the string;

generating an analog signal indicative of the drive voltage level; and providing a drive voltage to the string by using the analog signal indicative of the drive voltage level and a second analog feedback signal indicative of the current flowing through the string of light emitting diodes.

17. The method of claim 16, further comprising:

latching the processed digital data;

ceasing processing the digital data; and continuing providing the drive voltage to the string using the latched processed digital data and the second analog feedback signal.

18. The method of claim 17, further comprising placing a digital signal processor for processing the digital data into a non-operational mode prior to latching the processed digital data.

* * * * *

UNITED STATES PATENT AND TRADEMARK OFFICE

CERTIFICATE OF CORRECTION

PATENT NO. : 8,049,708 B2
APPLICATION NO. : 11/652739
DATED : November 1, 2011
INVENTOR(S) : Hendrick Santo et al.

It is certified that error appears in the above-identified patent and that said Letters Patent is hereby corrected as shown below:

Column 6, line 67, delete “latching” and insert -- latching signal --

Column 7, line 1, delete “signal” and insert -- digital signal --

Signed and Sealed this
Third Day of January, 2012

David J. Kappos

David J. Kappos
*Director of the United States Patent and Trademark Office*